US005438350A

United States Patent [19]

Kerry

[11] Patent Number: 5,438,350

[45] Date of Patent: Aug. 1, 1995

[54] METHOD OF OPERATING MULTI-CHANNEL ARRAY DROPLET DEPOSITION APPARATUS

[75] Inventor: Nicholas J. Kerry, Cambridge, Great Britain

[73] Assignee: XAAR Limited, Cambridge, United Kingdom

[21] Appl. No.: 39,365

[22] PCT Filed: Oct. 14, 1991

[86] PCT No.: PCT/GB91/01784

§ 371 Date: Jun. 10, 1993

§ 102(e) Date: Jun. 10, 1993

[87] PCT Pub. No.: WO92/06848

PCT Pub. Date: Apr. 30, 1992

[30] Foreign Application Priority Data

Oct. 18, 1990 [GB] United Kingdom ..... 9022662

[51] Int. Cl.[6] ..... B41J 2/045

[52] U.S. Cl. ..... 347/12; 347/94; 347/69

[58] Field of Search ..... 346/1.1, 140 R; 347/11, 347/12, 13, 94, 68, 69

[56] References Cited

U.S. PATENT DOCUMENTS

| | | | |
|---|---|---|---|
| 4,296,421 | 10/1981 | Hara et al. | 346/140 R |
| 4,381,515 | 4/1983 | Bain | 346/140 R |
| 4,584,590 | 4/1986 | Fischbeck et al. | 346/140 R |
| 4,590,482 | 5/1986 | Hay et al. | 346/1.1 |
| 4,825,227 | 4/1989 | Fischbeck et al. | 346/1.1 |
| 4,835,435 | 5/1989 | Yeung et al. | 310/324 |
| 4,879,568 | 11/1989 | Bartky et al. | 346/140 R |
| 4,887,100 | 12/1989 | Michaelis et al. | 346/140 R |
| 5,028,812 | 7/1991 | Bartky | 307/246 |

FOREIGN PATENT DOCUMENTS

| | | |
|---|---|---|
| 43286A1 | 1/1982 | European Pat. Off. . |
| 278590A1 | 8/1988 | European Pat. Off. . |
| 376606A1 | 7/1990 | European Pat. Off. . |

*Primary Examiner*—Mark J. Reinhart
*Assistant Examiner*—Alrick Bobb
*Attorney, Agent, or Firm*—Marshall, O'Toole, Gerstein, Murray & Borun

[57] ABSTRACT

Multi-channel droplet deposition apparatus of the kind having an array of parallel channels (1–11) with which respective nozzles and common ink supply communicate and in which electrically actuable devices (21–31) are located in relation to said channels to impart energy pulses to selected channels for effecting droplet ejection therefrom is operated by applying energy pulses to selected channels of the array and channels in the vicinity of the selected channels the amplitudes of which depend on the value of the compliance ratio of the channel walls to the droplet liquid and which together produce a pressure distribution in the channels to which they are applied which both effects droplet ejection from only said selected channels and is substantially free from pressure crosstalk between said selected channels or between said selected channels and other channels of the array.

33 Claims, 1 Drawing Sheet

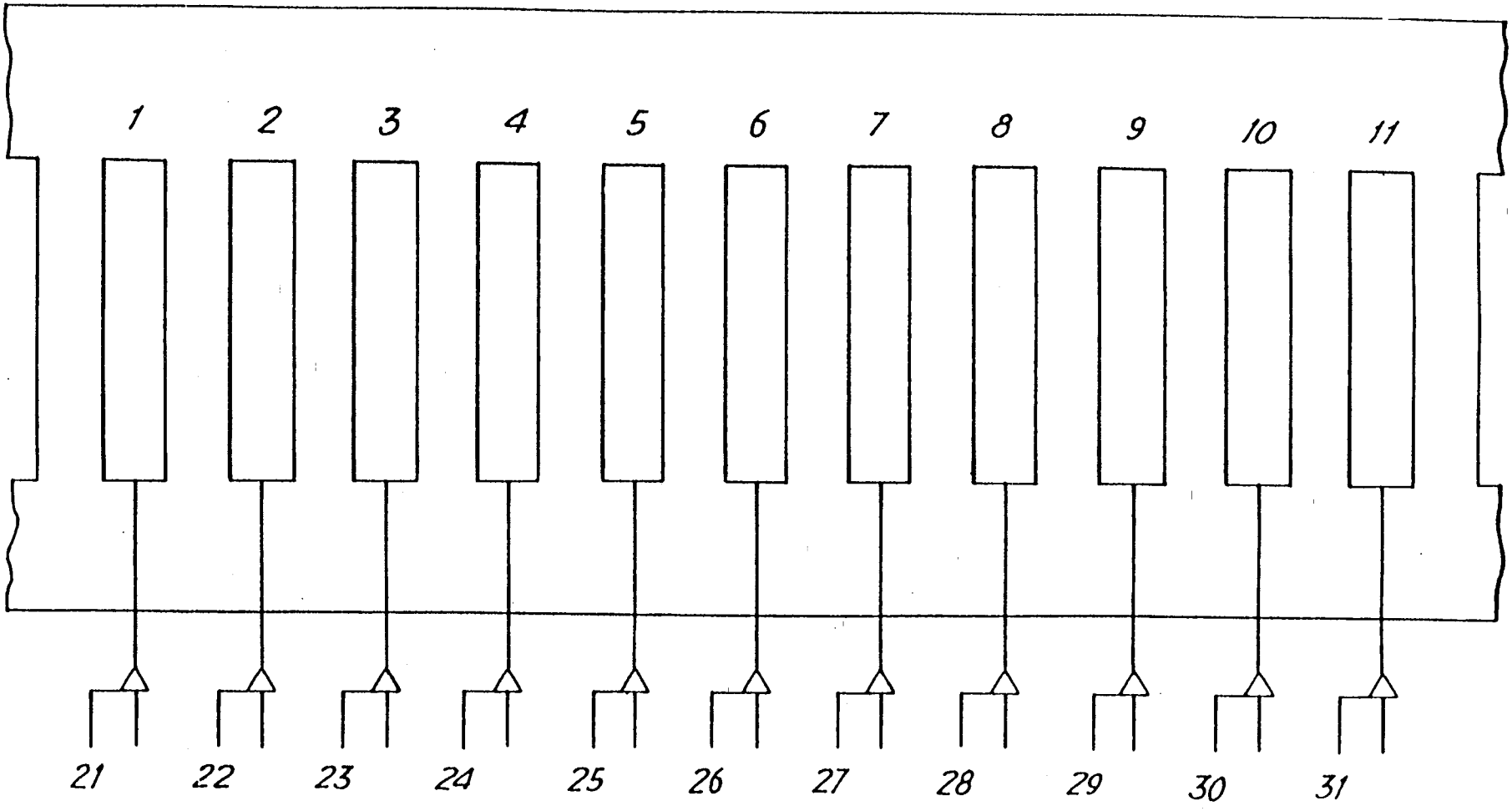
1
2
3
4
5
6
7
8
9
10
11
21
22
23
24
25
26
27
28
29
30
31

METHOD OF OPERATING MULTI-CHANNEL ARRAY DROPLET DEPOSITION APPARATUS

BACKGROUND OF THE INVENTION

This invention relates to multi-channel array droplet deposition apparatus and, more particularly, to a method of operating such apparatus of the kind comprising an array of parallel channels, respective nozzles communicating with said channels for ejection of droplets of liquid from the channels, droplet liquid supply means connected with the channels and electrically actuable means located in relation co said channels to impart energy pulses to respective selected channels for effecting droplet ejection from the nozzles of the channels selected. A particular case of droplet deposition apparatus of the kind sec forth is the, so-called, drop-on-demand ink jet printhead. The need exists to print ink dots in response to electronic print data at a high resolution, less than is readily resolved by the eye at a convenient reading distance. Many types of ink jet array have been proposed including U.S. Pat. No. 4,296,421 which operates on the thermal bubble jet principle and U.S. Pat. No. 4,584,590 which discloses one form of piezo-electric shear mode activated array. A further type of shear mode actuated array in which piezo-electric shear mode actuated channel dividing walls are employed is disclosed in U.S. Pat. Nos. 4,879,568 and 4,887,100 assigned to the assignee.

In the piezo-electric shared wall actuator array disclosed in U.S. Pat. No. 4,887,100 it is preferred that the-wall actuators are compliant, firstly because this leads to a higher linear density of channels and therefore assists to produce a high print resolution. A further reason is that the transduction of energy from the actuating voltage to pressure in. the ink channels and subsequently to the ejection of ink from the nozzle to form drops is most efficient when the walls are compliant. In this type of wall actuator it may accordingly be chosen in order to satisfy this condition that the value of:

$$\text{Compliance ratio} = K = \frac{\text{Compliance of the actuator wall}}{\text{Compliance of the ink in the channel}}$$

is in the range $0.2<K<2$. The operating state requiring maximum operating voltage occurs when all the odd (or even) numbered channels are actuated. The minimum value of this voltage occurs when $K=0.5$. It was also apparent that crosstalk between channels increases as the compliance increases. It is important that an ink droplet should be ejected only from those channels that are selected for printing and that pressure developed through crosstalk is maintained safely below the level that might cause a spurious drop to be ejected. In U.S. Pat. No. 4,887,100 (Col. 5, L40–50 and Col. 15, L15–23), it was indicated that there would generally be a limiting compliance where crosstalk would make operation impractical. However, a method was described therein by reference to FIG. 9 whereby crosstalk could be eliminated mechanically and operation could then take place without regard to the effect of compliance on crosstalk.

It was also recognised that crosstalk due to wall compliance could, in principle, be compensated by choosing an appropriate array of voltage values and a method of generating such voltage values is disclosed in U.S. Pat. No. 5,028,812.

The presence of crosstalk due to wall compliance in ink. jet printheads which are constructed with inactive walls between adjacent ink channels has not been reported in the literature. Such printheads include the thermal bubble jet and piezo-electric roof mode constructions. The absence of reports of crosstalk in these cases could be attributable to constructions in which the walls between adjacent channels are substantially rigid. In that case the channels are more widely separated than is necessary. After adopting the results of the present invention higher density array printheads substantially free of crosstalk can be constructed.

Compliant crosstalk, however, is disclosed in U.S. Pat. No. 4,381,515. This reference describes moreover a method of compensating for what is referred to as both positive and negative crosstalk, by introducing a network of compensating passive resistors. This proposal however is not applicable to the type of array disclosed in U.S. Pat. No. 4,887,100, since this array incorporates capacitors (representing the piezo-electric actuators), which are in parallel with the actuating signal lines. In U.S. Pat. No. 4,381,515, the actuators are in series with the signal lines. Nor is it relevant to arrays such as U.S. Pat. No. 4,296,421 where the actuating elements are resistive elements.

SUMMARY OF THE INVENTION

It is an object of the present invention to provide a method of operating droplet deposition apparatus of the kind set forth which achieves substantially improved reduction of crosstalk. A further object is to achieve by an exclusively electrical method the said substantial reduction of crosstalk.

The present invention consists in the method of operating a multi-channel array pulsed droplet deposition apparatus comprising an array of parallel channels, respective nozzles communicating with said channels for ejection of droplets of liquid from the channels, droplet liquid supply means connected with the channels and electrically actuable means located in relation to said channels to impart energy pulses to respective selected channels for effecting droplet ejection from the nozzles of the channels selected, characterised by applying energy pulses to the droplet liquid in channels of the array including said selected channels and channels in the vicinity of said selected channels the amplitudes of which are dependant upon the value of the compliance ratio of a channel wall to the droplet liquid in said channel and which together produce a pressure distribution in the channels to which they are applied which both effects droplet ejection from only said selected channels and is substantially free from pressure crosstalk between said selected channels or between said selected channels and other channels of the array.

The invention also consists in the method of operating a multi-channel array pulsed droplet deposition apparatus comprising an array of parallel channels, respective nozzles communicating with said channels for ejection of droplets of liquid from the channels, droplet liquid supply means connected with the channels and electrically actuable means located in relation to said channels to impart energy pulses to respective selected channels for effecting droplet ejection from the nozzles of the channels selected, characterised by applying energy pulses to the droplet liquid in channels of the array including said selected channels and channels in the vicinity of said selected channels the amplitudes of which are dependant. upon the value of the compliance ratio of a channel wall to the droplet liquid in said channel and which together develop a distribution of potential energy stored in the channels to which said pulses are applied which effects droplet ejection only from said selected channels at substantially uniform momentum between said selected channels.

Advantageously, the energy pulses are applied to the droplet liquid in channels of the array to produce said pressure distribution by means of unipolar voltages supplied by the electrically actuable means of said channels.

Suitably, said unipolar voltages are formed by adding a constant voltage to each of the channel voltages applied to produce the energy pulses which create said pressure distribution in said selected channels and said channels in the vicinity thereof.

In one form of the method of the invention in which channel dividing walls of the droplet deposition apparatus are compliant and provided each with said electrically actuable means so that actuation of opposed channel dividing side walls by said electrically actuable means effects droplet expulsion from the channel therebetween, the channels being divided into two groups of which the channels of one group alternate with those of the other group, a scheme of voltage actuation to reduce crosstalk is employed that generates spray pressures at least in a region of the array including actuated channels, as follows,

| Type of Channel | Actuated Neighbours | Applied Pressure |
|---|---|---|
| Actuated Group | | |
| Actuated | — | P |
| Non-Actuated | — | 0 |
| Non-Actuated Group | 2 | −P |
| | 1 | −P/2 |
| | 0 | 0 |

where P represents the pressure applied to an actuated channel.

Preferably said scheme of voltage actuation is as follows:

| Type of Channel | Actuated Neighbour | Proportionality of Applied Voltage |
|---|---|---|
| Actuated Group | | |
| Actuated | — | 1 + 2K |
| Non-Actuated | — | 0 |
| Non-Actuated Group | 2 | −2K |
| | 1 | −K |
| | 0 | 0 |

where K equals ratio of the compliance of the channel walls to the compliance of the droplet deposition liquid in the channel. This scheme of voltage actuation is modified to provide unipolar applied voltages by adding a voltage of magnitude proportional to +2K to each of the voltages applied to said selected channels and said channels in the vicinity of said selected channels. It is of further advantage to scale the voltages applied to said selected channels and said channels in the vicinity of said selected channels by a constant of proportionality. This constant may include factor 1/(1+4K) so that the voltage when all the odd (or even) numbered channels are actuated is normalised and/or a further factor which together enable an actuation voltage of minimum value to be applied to those channels from which droplet ejection is to be effected.

In another form of the invention in which the channel array comprises open topped channels formed in a base from which compliant inactive channel dividing side walls are upstanding the open topped channels being closed by active wall means actuable by said electrically actuable means, the method is characterised by applying actuating voltages by means of said electrically actuable means to selected channels of the array and channels in the vicinity of said selected channels so that pressure pulses are developed exclusively in said selected channels and are effective to cause droplet ejection from said selected channels.

The invention also consists in the method of operating a multi-channel array droplet deposition apparatus comprising an array of parallel channels uniformly spaced by channel separating side walls, respective nozzles communicating with said channels for ejection of droplets of liquid from the channels, droplet liquid supply means connected with the channels and electrically actuable means located in relation to said channel separating side walls to enable application thereto of voltages to effect droplet ejection from the channels, characterised by selecting a group of successive channels of the array and applying to the channels of said group and channels adjoining said selected group at opposite sides thereof an oscillatory voltage at or substantially at the longitudinal resonant frequency of the channels and of amplitude, at each channel to which it is applied, to effect in a first half cycle of voltage droplet ejection from alternate channels of the selected group and in a second half cycle of said voltage droplet ejection from the rems/ninE channels of the group, the amplitudes of said applied voltages being so dependent on the compliance ratio of a channel separating wall and the droplet liquid in said channel as to compensate for pressure cross-talk between channels of the selected group or between said selected group of channels and other channels of the array.

BRIEF DESCRIPTION OF THE DRAWING

The invention will now be described by way of example with reference to the accompanying drawing which is a transverse cross sectional view of a droplet deposition apparatus, suitably, a drop-on-demand ink jet printer of the kind described in U.S. Pat. No. 4,887,100.

DESCRIPTION OF THE PREFERRED EMBODIMENTS

The multi-channel array droplet deposition apparatus, a section of which is illustrated in the drawing, comprises an array of eleven channels numbered 1 to 11 of which, for example, channels 3, 7 and 9 are actuated by shear mode displacement of opposite side walls of those channels. The arrangement is typically disclosed in U.S. Pat. No. 4,887,100, the contents of which are herein incorporated by reference. The channels of the array comprise two groups each of alternate channels, the odd numbered channels forming one and the even numbered channels the other such group. At each printing operation selected channels of one group are actuated and at the next printing operation selected channels of the other group are actuated. It will be apparent, accordingly, that each channel dividing side wall forms part of the actuating means of the channels on opposite sides thereof.

If the channel dividing side walls, which are the channel actuators, are rigid, that is to say, if they can be displaced each in response to an actuation voltage applied to electrodes on opposite, channel facing side walls thereof and have zero compliance in response to pressure, then the pattern of actuation and the channel pressures take the form

| | Channel number | | | | | | | | | | |
|---|---|---|---|---|---|---|---|---|---|---|---|
| | 1 | 2 | 3 | 4 | 5 | 6 | 7 | 8 | 9 | 10 | 11 |
| Channels actuated | | | * | | | | * | | * | | |
| Channel pressures | 0 | $\frac{-P}{2}$ | P | $\frac{-P}{2}$ | 0 | $\frac{-P}{2}$ | P | −P | P | $\frac{-P}{2}$ | 0 |

With zero compliance it is seen that the odd numbered channels which are actuated have a pressure P, but all non-actuated channels in the group of odd numbered channels have zero pressure. Among the even numbered group of channels, which are not actuated, those channels adjacent to two actuated channels have pressure −P, those next to one actuated channel a pressure and those not adjacent to any actuated channel a zero pressure.

This pressure pattern satisfies the condition of being free of crosstalk between actuated channels, since there is no overspill of pressure actuation from an actuated channel to another channel in the same (odd) group of channels. This pattern also satisfies the requirement when the walls have zero compliance that the channels, which are selected for actuation (i.e. the odd numbered channels 3, 7 and 9), each have equal stored potential energy and that the droplet momentum delivered into the respective nozzles of the selected channels by the action of the acoustic waves caused by actuation of the selected channels are substantially equal.

In an array with compliance ratio K the same pressure pattern satisfies the condition that the array simulates an array having zero compliance and is consequently "crosstalk free". Although the potential energy is now stored partially in the ink and partially in the walls, each channel has equal potential energy and the action of the acoustic waves again delivers the droplet momentum into the nozzles. One pattern of actuation voltages that satisfies the condition of establishing the "crosstalk free" pressure pattern is a set of voltages in proportion to

| Channel number | 1 | 2 | 3 | 4 | 5 | 6 | 7 | 8 | 9 | 10 | 11 |
|---|---|---|---|---|---|---|---|---|---|---|---|
| Channel voltages | 0 | −K | (1 + 2K) | −K | 0 | −K | (1 + 2K) | −2K | (1 + 2K) | −K | 0 |

In this solution channel drive transistors 21–31 in the drawing are obliged to handle both positive and negative voltages. It is more economical to use transistors of only one polarity to reduce the number of manufacturing steps when the transistor is an LSI integrated drive chip. If a constant voltage is added to all the channel voltages applied to the shared actuator array, it has no net effect on actuation. For example voltage 2K may be added to each channel voltage obtaining a set of voltages in proportion to

| Channel voltage | 2K | K | (1 + 4K) | K | 2K | K | (1 + 4K) | 0 | (1 + 4K) | K | 2K |
|---|---|---|---|---|---|---|---|---|---|---|---|

This set of voltages also generates the previous pressure pattern that is free of crosstalk.

When the relationship between the actuation voltage V and the ink fluid velocity in the nozzle is analysed, the operating state requiring maximum operating voltage occurs when a series of adjacent odd (or even) numbered channels are actuated. The minimum value of this voltage occurs when the actuator, ink channel section and the nozzle size are chosen (that is to say are "matched") for optimum energy transfer.

In particular the matching condition can be expressed in terms of the compliance ratio K.

$$V = \text{constant } M \times (We)$$

where (We) is the Weber Number or non dimensional velocity of ink flow through the nozzle, and where $$M = \frac{(1 + 4K)^{\frac{3}{4}}}{3.224K^{\frac{1}{2}}}.$$

From this formula it is deducible that there exists a best compliance ratio $K_{OPT}$ where the actuation voltage is a minimum. This occurs, when a group of adjacent odd (or even) channels are actuated, at the value $K = K_{OPT} = \frac{1}{2}$ and $M = 1$.

In the region close to $K_{OPT}$, the relationship for M can also be written in terms of $(K/K_{OPT})$ in the form $$M = \left( \frac{1}{3} \left( \frac{K_{OPT}}{K} \right)^{\frac{2}{3}} + \frac{2}{3} \left( \frac{K}{K_{OPT}} \right)^{\frac{1}{3}} \right)$$

in which again $M = 1$ when $K = K_{OPT}$. Calculation shows that the above expressions for M are not highly sensitive to K. Calculated values are

| | | | | | |
|---|---|---|---|---|---|
| K | 0.2 | 0.25 | 0.5 | 1 | 2 |
| $K_{OPT}$ | 0.5 | 0.5 | 0.5 | 0.5 | 0.5 |
| $M = \frac{(1 + 4K)^{\frac{3}{4}}}{3.224K^{\frac{1}{2}}}$. | 1.078 | 1.0433 | 1 | 1.0372 | 1.140 |

-continued

| | | | | | |
|---|---|---|---|---|---|
| $M = \left(\frac{1}{3}\left(\frac{K_{OPT}}{K}\right)^{\frac{2}{3}} + \frac{2}{3}\left(\frac{K}{K_{OPT}}\right)^{\frac{1}{3}}\right)$ | 1.105 | 1.049 | 1 | 1.057 | 1.190 |

The set of voltages that generates the pressure pattern free of cross talk can therefore be normalised into a form in proportion to However, in a region of the array remote from actuated channels, the applied voltage to both odd and even channels can fall towards zero with a small error.

| | Channel number | | | | | | | | | | |
|---|---|---|---|---|---|---|---|---|---|---|---|
| | 1 | 2 | 3 | 4 | 5 | 6 | 7 | 8 | 9 | 10 | 11 |
| Channel actuated | | | * | | | | * | | * | | |
| Channel voltages | $\frac{2KM}{(1+4K)}$ | $\frac{KM}{(1+4K)}$ | M | $\frac{KM}{(1+4K)}$ | $\frac{2KM}{(1+4K)}$ | $\frac{KM}{(1+4K)}$ | M | O | M | $\frac{KM}{(1+4K)}$ | $\frac{2KM}{(1+4K)}$ |

Thus it is seen that the channel voltages are scaled by a constant of Proportionality which includes factors M and 1/1+4K so that minimum voltage M may be applied to the actuated channels.

A set of voltages in proportion to the above derived values, it is observed, first generates pressures that are normalised when K is in a range close to $K_{OPT}=\frac{1}{2}$ if the printhead is an array of shared wall actuators.

The actuation rules, when selected odd channels in the array are actuated is that 1. The actuated channels in the add group have a voltage M applied.

2. The non-actuated channels in the odd group have voltage $$\frac{2KM}{(1+4K)}$$

applied.

3. The even channels adjacent two actuated channels have voltage zero applied.

4. The even channels adjacent to one actuated channel have voltage $$\frac{KM}{(1+4K)}$$

applied.

5. The remaining even channels adjacent to no actuated channels have voltage $$\frac{2KM}{(1+4K)}$$

applied.

In our co-pending U.S. patent application Ser. No. 07/594,772 U.S. Pat. No. 5,361,084, there is disclosed a method of operating the multi-channel array droplet deposition apparatus by applying sequences of pulses to selected channels of the array at or near the longitudinal acoustic resonant frequency of the channels. The number of pulses in each sequence determines the number of droplets ejected from the nozzles and deposited for printing.

In one preferred method of operation, when a group of adjacent channels is selected for operation, pressure is applied to the odd numbered (say) channels in the group as a result of actuation of the channels during one half of the resonance cycle and is then applied to the even numbered channels of the group duping the following half of the resonant cycle, so operating adjacent channels in alternate half phases of the resonant cycle. Consider, For example, a series of eleven channels numbered 1 to 11 of which Five channels numbered 4 to 8 are subjected to resonant operation. If the walls between the channels have zero compliance, then the pattern of actuation and the pressures to effect actuation in the channels described take the form

| | Channel number | | | | | | | | | | |
|---|---|---|---|---|---|---|---|---|---|---|---|
| | 1 | 2 | 3 | 4 | 5 | 6 | 7 | 8 | 9 | 10 | 11 |
| Odd number of channels actuated for drop ejection in one cycle | | | | * | * | * | * | * | | | |
| Pressure in first half cycle | 0 | 0 | $\frac{-P}{2}$ | +P | −P | +P | −P | +P | $\frac{-P}{2}$ | 0 | 0 |
| Pressure in second half cycle | 0 | 0 | $\frac{+P}{2}$ | −P | +P | −P | +P | −P | $\frac{+P}{2}$ | 0 | 0 |

In the above pressure pattern the pressure +P is selected to be above the threshold for drop ejection, while is below the threshold. Although the resonant pressures in the channels selected for drop ejection are denoted as +P and −P it will be evident that if the mean pressure is somewhat different from zero to promote ink replenishment, the basic principles of operation are not essentially modified.

In an array in which the channel walls have a compliance ratio K (which is greater than K=O, suitably $0.2<K<2$) then voltages which compensate for the wall compliance need to be applied. Such voltages generate the above pressure distribution. Also preferably the voltages are unipolar to simplify the drive transistors. Using the principles already described, a voltage array which compensates for the wall compliance takes the form for the sequence of five actuated channels as follows:

| | Channel number | | | | | | | | | | |
|---|---|---|---|---|---|---|---|---|---|---|---|
| | 1 | 2 | 3 | 4 | 5 | 6 | 7 | 8 | 9 | 10 | 11 |
| Voltage in a first half of the resonant cycle | $\frac{2KM}{(1+4K)}$ | $\frac{2KM}{(1+4K)}$ | $\frac{KM}{(1+4K)}$ | M | O | M | O | M | $\frac{KM}{(1+4K)}$ | $\frac{2KM}{(1+4K)}$ | $\frac{2KM}{(1+4K)}$ |
| Voltage in the second half of the resonant cycle | $\frac{1+2K}{1+4K}$ M | $\frac{1+2K}{1+4K}$ M | $\frac{1+3K}{1+4K}$ M | O | M | O | M | O | $\frac{1+3K}{1+4K}$ M | $\frac{1+2K}{1+4K}$ M | $\frac{1+2K}{1+4K}$ M |

In the above table of voltages, M represents the scaling factor on voltage level required to eject drops when all the channels in a group of adjacent channels are selected for operation. Accordingly, the five channels 4 to 8 which are selected have voltages O and M in time in alternative phases and also alternate spatially to generate pressures +P and −P. Channels 3 and 9 have only one neighbouring actuated channel, so that they are subjected to voltages $$\frac{KM}{(1+4K)} \text{ and } \frac{(1+3K)M}{(1+4K)},$$

so generating alternating pressures −P/2 and +P/2.

However, channels 1, 2 and 3 and likewise 9, 10 and 11 have voltages moving in unison, so that there is no actuating wall displacement thereof except for the values sufficient to compensate for crosstalk in these channels and thus no pressure is generated.

It will be seen that the voltages in the channels which are not actuated nevertheless are subjected to oscillatory voltages. Since, however, neighbouring channels have the same polarity of voltage at any time, these signals do not generate pressure.

In the case of an even numbered group of actuated channels, it is found that the voltages applied in the non-actuated channels are again subjected to alternating voltages. In this case, however, correct compensation is only obtained when the alternating voltages on either side of the group are of opposite phase. The pressures for an even numbered group of actuated channels takes the form:

| | Channel number | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| Even number of channels actuated for drop ejection in one cycle | | | | * | * | * | * | * | * | | | |
| Pressure in first half cycle | 0 | 0 | $\frac{-P}{2}$ | +P | −P | +P | −P | +P | −P | $\frac{+P}{2}$ | 0 | 0 |
| Pressure in second half cycle | 0 | 0 | $\frac{+P}{2}$ | −P | +P | −P | +P | −P | +P | $\frac{-P}{2}$ | 0 | 0 |

When the walls are compliant the table of voltages required to compensate for the compliance becomes, for the sequence of even actuated channels,

| | Channel number | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| Voltage in a first half of the resonant cycle | $\frac{2KM}{(1+4K)}$ | $\frac{2KM}{(1+4K)}$ | $\frac{KM}{(1+4K)}$ | M | O | M | O | M | O | $\frac{\{1+3K\}}{\{1+4K\}}$ M | $\frac{\{1+2K\}}{\{1+4K\}}$ M | $\frac{\{1+2K\}}{\{1+4K\}}$ M |
| Voltage in the second half of the resonant cycle | $\frac{\{1+2K\}}{\{1+4K\}}$ M | $\frac{\{1+2K\}}{\{1+4K\}}$ M | $\frac{\{1+3K\}}{\{1+4K\}}$ M | O | M | O | M | O | M | $\frac{KM}{(1+4K)}$ | $\frac{2KM}{(1+4K)}$ | $\frac{2KM}{(1+4K)}$ |

Again it is the non-printing channels that are subjected to compensated voltages, but for the even sequence of printed channels the voltages, which are applied in unison and, therefore, generate no pressures. are in opposite phase on either side to provide the correct pressure compensation.

The accompanying analysis shows that similar correction applies to piezo-electric roof mode actuation. However, in this case actuation is not limited to odd and even numbered channels in alternate cycles, but all channels may be actuated at the same time. Such an array is described in U.S. Pat. Nos. 4,584,590 and 4,825,227.

In this instance also the optimum actuation voltage does not depend on the inter channel compliance ratio K consequently the normalisation rules are different. For example, if channels 3, 6, 7 and 8 are actuated

| | Channel number | | | | | | | | | | |
|---|---|---|---|---|---|---|---|---|---|---|---|
| | 1 | 2 | 3 | 4 | 5 | 6 | 7 | 8 | 9 | 10 | 11 |
| Channel actuated | | | * | | | * | * | * | | | |

-continued

| | Channel number | | | | | | | | | | |
|---|---|---|---|---|---|---|---|---|---|---|---|
| | 1 | 2 | 3 | 4 | 5 | 6 | 7 | 8 | 9 | 10 | 11 |
| Channel pressure | 0 | 0 | P | 0 | 0 | P | P | P | 0 | 0 | 0 |
| Channel voltage | 0 | −K | (1 + 2K) | −K | −K | (1 + K) | 1 | (1 + K) | −K | 0 | 0 |

Since negative applied voltages are not desirable the set of voltages above may be written, as K varies, by adding any suitable voltage corrections to each channel, such as 2K.

Channel voltage 2K, K, (1+4K), K, K, (1+3K). (1,2K). (1+3K). K, 2K, 2K

Normally K will be small so that the added voltage 2K will not cause drop ejection. The values can be normalised to set the voltage applied to a single isolated channel (such as channel 3) to unity.

$$\text{Channel Voltage}\ \frac{2K}{(1+4K)}, \frac{K}{(1+4K)}, 1\ \frac{K}{(1+4K)}, \frac{K}{(1+4K)},$$

$$\frac{(1+3K)}{(1+4K)}, \frac{(1+2K)}{(1+4K)}, \frac{(1+3K)}{(1+4K)}, \frac{K}{(1+4K)},$$

$$\frac{2K}{(1+4K)}\ \frac{2K}{(1+4K)}$$

Accordingly for an array capable of actuating any channel, where the compliance ratio defining crosstalk is K

| Type of Channel | Actuated Neighbours | Proportionality of Applied Voltage |
|---|---|---|
| Actuated | 0 | 1 |
| | 1 | $\frac{1+3K}{1+4K}$ |
| | 2 | $\frac{1+2K}{1+4K}$ |
| Non-actuated | 0 | $\frac{2K}{1+4K}$ |
| | 1 | $\frac{K}{1+4K}$ |
| | 2 | 0 |

The same general rules apply to other types of array printheads, such as bubble jet, allowing for the fact that the pressure and voltage of actuation are in this case no longer linear.

Accordingly, it will be seen that a scheme of actuation exists in which inter channel compliance in the array does not result in inter channel crosstalk.

There follows a note on the mathematics from which the desired pressure pattern for a shared wall array is developed, SHARED WALL INK JET PRINTHEAD (as described in U.S. Pat. No. 4,887,100)

The array is modelled as a number of identical two-dimensional channels of width $\sigma$ containing ink. The walls separating the channels are compliant, and a pressure difference across the walls will cause a lateral deflection. Wall inertia can be neglected as the resonant frequency of wall vibration is much higher than the frequencies associated with drop ejection. Since the wall compliance arises primarily from the built-in conditions at the top and bottom of the walls, also ignored is any stiffness associated with longitudinal flexure and wall compliance is represented by a simple transverse compliance k, The channel walls are of a piezo-electric material, and applying an electric field across the walls has the effect of altering their equilibrium position. The displacement of the equilibrium position of the wall is proportional to the applied voltage difference, in which the activity depends on the properties of the material and on the wall geometry.

Under the conditions set forth there can now be obtained the following system of equations:

$$P_{oi} = \frac{\rho_o C_o^2}{b}\left(R(P_{oi} - 2P_{oi} + P_{oi} - 1) - \alpha(V_{i-1} - 2V_i + V_{i-1})\right) \quad (1)$$

These can be cast in matrix form as follows:

$$(\underline{I} + K\underline{A})P_o = \alpha\frac{\rho_o C_o^2}{b}\cdot A\cdot \underline{V} \quad (2)$$

where $K=(\rho_o C_o^2 R/b)$ is the ratio between the compliance of the wall and the effective compliance of the ink in the channel, $\underline{V}$ is the vector of actuation voltages, $\underline{p}$ is the vector of channel pressures, and $\underline{A}$ is the second-difference matrix:

$$\underline{A} = \begin{bmatrix} 1 & -1 & 0 & 0 & 0 & 0 & \\ -1 & 2 & -1 & 0 & 0 & 0 & \\ 0 & -1 & 2 & -1 & 0 & 0 & \cdots \\ 0 & 0 & -1 & 2 & -1 & 0 & \\ 0 & 0 & 0 & -1 & 2 & -1 & \\ & & & \cdot & \cdot & \cdot & \end{bmatrix} \quad (3)$$

$$I = \begin{bmatrix} 1 & 0 & 0 & 0 & 0 \\ 0 & 1 & 0 & 0 & 0 \\ 0 & 0 & 1 & 0 & 0 \\ 0 & 0 & 0 & 1 & 0 \\ 0 & 0 & 0 & 0 & 1 \\ & \cdot & \cdot & \cdot & \end{bmatrix}$$

Here there has been chosen the top-left hand corner entry of $\underline{A}$ to correspond to a rigid wall at the end of the array. Other end conditions are possible. and only change the details of the analysis.

The matrix equation enables the pressure field generated by a given applied voltage pattern to be computed, and has a number of interesting features. The first is that a voltage pattern which is proportional to any eigenvector of A will generate a pressure pattern corresponding to the same eigenvector. The second feature is that the matrix $\underline{A}$ is singular. This is an indication of the fact that it is not possible to change the average pressure in a shared-wall array by shear mode actuation.

In the above equations the following nomenclature has been used.

Symbols $\underline{A}$ second difference matrix $\bar{b}$ channel width $C_o$ speed of sound in the ink alone $\underline{I}$ identity matrix $\bar{R}$ transverse wall compliance $P_o$ channel pressure in response to actuation $P_{oi-1}$, $P_{oi}$, $P_{oi+1}$ pressure in i−1, 1 and i+1 channels V actuation voltage $V_{i-1}$, $V_i$, $V_{i+1}$ voltage applied to electrodes in i−1, i, and i+1 channels $\alpha$ activity of a wall, pressure per voltage difference applied K compliance ratio $\rho_o$ ink density.

$\underline{a}$ vector of the logic state of the actuated lines.

CANCELLATION OF CROSSTALK

Cancellation of crosstalk in a shared wall actuator can be effected by solving equation (2) to determine the drive voltage pattern needed to generate the required channel pressures. The figure below shows an example firing pattern and the corresponding required pressure pattern.

| | | | | | | | | | | | |
|---|---|---|---|---|---|---|---|---|---|---|---|
| Channels | \| | \| | \| | \| | \| | \| | \| | \| | \| | \| | \| |
| actuated | | | * | | | | * | | * | | |
| pressures | 0 | | | | 0 | | | | | | 0 |

Because the matrix equation is singular there is no unique solution—any uniform voltage can be added to the applied pattern without affecting the pressures generated. This has the consequence that the need for negative drive voltages in a compensation scheme can be eliminated, which is of considerable benefit in simplifying the electronic design.

The above pressure pattern can be written $$p_o = \tfrac{1}{2}P \times \underline{A} \cdot \underline{a}$$

where $\underline{a}$ is the vector of the logic state of actuated lines. Substituting this into the matrix equation, we obtain:

$$\frac{1}{2} Px(\underline{I} + K\underline{A})\underline{A} \cdot a = \alpha \frac{\rho_o C_o^2}{b} \cdot \underline{A} \cdot \underline{V}$$

If we "cancel" $\underline{A}$ from both sides, we get:

$$\underline{V} = (\text{constant})\ (\underline{I} + K\underline{A})$$

which looks like this:

| | | | | | | | | | | | |
|---|---|---|---|---|---|---|---|---|---|---|---|
| Channels | \| | \| | \| | \| | \| | \| | \| | \| | \| | \| | \| |
| actuated | | | * | | | | * | | * | | |
| Voltage scale factor | 0 | $-K$ | $1+2K$ | $-K$ | 0 | $-K$ | $1+2K$ | $-2K$ | $1+2K$ | $-K$ | 0 |

This solution can be substituted into the matrix equation and checked that the right answer is obtained. Now, to remove the negative voltages 2K is added to each coefficient.

The compensation scheme with no negative voltages is described as follows. A voltage of $(1+4K)V_o$ is applied to the lines which are fired, where $V_o$ is the voltage that would generate the necessary actuation pressure in the absence of actuator compliance. Voltage $2KV_o$ is applied to lines which are not adjacent to the actuated lines, the difference $(1+2K)V_o$ representing the increased voltage necessary to overcome pressure loss due to compliance effects.

I claim:

1. A method of operating a multi-channel array pulsed droplet deposition apparatus comprising an array of parallel channels, channel walls each separating one channel of the array from an adjacent channel in the array, the channel walls having a wall compliance, respective nozzles communicating with said channels for ejection of droplets of liquid from the channels, droplet liquid supply means connected with the channels for the supply to the channels of droplet liquid having a liquid compliance, and electrically actuable means located in relation to said channels for imparting energy pulses to droplet liquid in the channels so that droplets are ejected from the nozzles of selected ones of the channels, the method comprising the steps of applying through said electrically actuable means energy pulses of a first amplitude to the droplet liquid in selected ones of the channels of the array and applying through said electrically actuable means energy pulse of a second amplitude to the liquid in at least some others of the channels in the array, said first amplitude and said second amplitude being dependant upon a ratio of said wall compliance and said liquid compliance, to produce a pressure distribution in the channels of the array which effects droplet ejection from only said selected channels and is substantially free from pressure crosstalk between said selected channels or between said selected channels and other channels of the array.

2. The method claimed in claim 1, wherein the step of applying energy pulses through said electrically actuable means comprises applying channel voltages for each of said channels.

3. The method claimed in claim 2, wherein said channel voltages are unipolar.

4. The method claimed in claim 3, characterised by forming said unipolar voltages by adding a constant voltage to each of the channel voltages.

5. The method claimed in claim 1 and in which the channel walls of the droplet deposition apparatus are compliant and are each provided with said electrically actuable means so that actuation of opposed channel walls by said electrically actuable means effects droplet expulsion from a channel therebetween, the channels being divided in two groups of which the channels of one group alternate with those of the other group, characterized by employing a scheme of voltage actuation to reduce crosstalk that generates array pressures at least in a region of the array including actuated channels, as follows,

| Type of Channel | Actuated Neighbours | Applied Pressure |
|---|---|---|
| Actuated Group | | |
| Actuated | — | P |
| Non-Actuated | | 0 |

-continued

| Type of Channel | Actuated Neighbours | Applied Pressure |
|---|---|---|
| Non-Actuated Group | 2 | −P |
| | 1 | −P/2 |
| | 0 | 0 |

where P represents the pressure applied to an actuated channel.

6. The method claimed in claim 4, characterised by employing a scheme of voltage actuation, as follows:

| Type of Channel | Actuated Neighbour | Proportionality of Applied Voltage |
|---|---|---|
| Actuated Group | | |
| Actuated | — | 1 + 2K |
| Non-Actuated | — | 0 |
| Non-Actuated Group | 2 | −2K |
| | 1 | −K |
| | 0 | 0 |

where K equals the ratio of the compliance of the channel walls to the compliance of the droplet deposition liquid.

7. The method claimed in claim 6, characterised by adding a voltage of magnitude proportional to +2K to each of the voltages applied to said selected channels and said channels in a vicinity of said selected channels to provide said unipolar voltages.

8. The method claimed in claim 6, characterised by further scaling the voltages applied to said selected channels and said channels in a vicinity of said selected channels by a constant of proportionality.

9. The method claimed in claim 8, characterised in that said constant of proportionality includes 1/(1+4K).

10. The method claimed in claim 7, characterised by further scaling a voltages applied to said selected channels and said channels in a vicinity of said selected channels by a constant of proportionality.

11. The method claimed in claim 10, characterised in that said constant of porportionality includes 1/(1+4K).

12. The method claimed in claim 6, characterised by further scaling a voltages applied to said selected channels and said channels in a vicinity of said selected channels by a constant of proportionality which includes M, where $$M = \frac{(1 + 4K)^{\frac{3}{4}}}{3.224K^{\frac{1}{2}}}.$$

13. The method claimed in claim 6, characterised by further scaling a voltages applied to said selected channels and said channels in a vicinity of said selected channels by a constant of porportionality which includes M, where $$M = \left(\frac{1}{3}\left(\frac{K_{OPT}}{K}\right)^{\frac{2}{3}} + \frac{2}{3}\left(\frac{K}{K_{OPT}}\right)^{\frac{1}{3}}\right)$$

and $K_{OPT}$ is an optimum value of K which occurs when the voltages applied to said selected channels to effect droplet ejection therefrom are a minimum.

14. The method claimed in claim 13, characterised in that $K_{OPT}$ is chosen to equal 0.5 when said selected channels comprise an entire group of alternate channels of the array.

15. A method claimed in claim 1, in which the channel array comprises open topped channels formed in a base from which compliant inactive channel dividing side walls are upstanding, the open topped channels being each closed by an active wall actuable by said electrically actuable means, characterised by applying actuating voltages to selected channels using said electrically actuable means.

16. The method claimed in claim 15, characterised by rendering unipolar said actuating voltages by adding to each of said actuating voltages a voltage proportional to 2K where K is the compliance ratio.

17. The method claimed in claim 16, characterised by further scaling the actuating voltages by a constant of proportionality.

18. The method claimed in claim 17, characterised by employing a scheme of voltage actuation, as follows:

| Type of Channel | Actuated Neighbours | Proportionality of Applied Voltage |
|---|---|---|
| Actuated | 0 | 1 |
| | 1 | $\frac{1 + 3K}{1 + 4K}$ |
| | 2 | $\frac{1 + 2K}{1 + 4K}$ |
| Non-actuated | 0 | $\frac{2K}{1 + 4K}$ |
| | 1 | $\frac{K}{1 + 4K}$ |
| | 2 | 0 |

19. A method of operating a multi-channel array pulsed droplet deposition apparatus comprising an array of parallel channels, channel walls each separating one channel of the array from an adjacent channel in the array, the channel walls having a wall compliance, respective nozzles communicating with said channels for ejection of droplets of liquid from the channels, droplet liquid supply means connected with the channels for the supply to the channels of droplet liquid having a liquid compliance, and electrically actuable means located in relation to said channels for imparting energy pulses to droplet liquid in the channels so that droplets are effected from the nozzles of selected one of the channels, the method comprising the steps of applying through said electrically actuable means energy pulses of a first amplitude to the droplet liquid in selected ones of the channels of the array and applying through said electrically actuable means energy pulses of a second amplitude to the liquid in at least some others of the channels in the array, said first amplitude and to said second amplitude being dependant upon a ratio of said wall compliance and said liquid compliance, to develop a distribution of potential energy stored in the channels to which said pulses are applied which effects droplet ejection only from said selected channels at substantially uniform momentum between said selected channels.

20. The method claimed in claim 19, wherein the step of applying energy pulses through said electrically actuable means comprises applying a unipolar channel voltage for each of said channels.

21. The method of claim 20 in which the channel walls of the droplet deposition apparatus are compliant and are each provided with said electrically actuable means so that actuation of opposed channel walls by said electrically actuable means effects droplet expulsion from a channel therebetween, the channels being divided in two groups of which the channels of one group alternate with those of the other group, characterized by employing a scheme of voltage actuation to reduce crosstalk that generates array pressures at least in a region of the array including actuated channels, as follows,

| Type of Channel | Actuated Neighbours | Applied Pressure |
|---|---|---|
| Actuated Group | | |
| Actuated | — | P |
| Non-Actuated | | 0 |
| Non-Actuated Group | 2 | −P |
| | 1 | −P/2 |
| | 0 | 0 |

where P represents the pressure applied to an actuated channel.

22. The method of claim 20, characterized by employing a scheme of voltage actuation, as follows:

| Type of Channel | Actuated Neighbour | Proportionality of Applied Voltage |
|---|---|---|
| Actuated Group | | |
| Actuated | — | 1 + 2K |
| Non-Actuated | — | 0 |
| Non-Actuated Group | 2 | −2K |
| | 1 | −K |
| | 0 | 0 |

where K equals the ratio of the compliance of the channel walls to the compliance of the droplet deposition liquid.

23. The method of claim 22, characterized by adding a voltage of magnitude proportional to +2K to each of the voltages applied to said selected channels and said channels in a vicinity of said selected channels to provide said unipolar voltages.

24. The method of claim 19 in which the channels array comprises open topped channels formed in a base from which compliant inactive channel dividing side walls are upstanding, the open topped channels each being closed by an active wall actuable by said electrically actuable means, characterised by applying actuating voltages to selected channels using said electrically actuable means.

25. A method of operating a multi-channel array pulsed droplet deposition apparatus comprising an array of parallel channels uniformly spaced by channel separating side walls, said side walls having a wall compliance, respective nozzles communicating with said channels for ejection of droplets of liquid from the channels, droplet liquid supply means connected with the channels for the supply to the channels of droplet liquid having a liquid compliance, and electrically actuable means located in relation to said channels for imparting energy pulses to droplet liquid in the channels to effect droplet ejection from the channels, comprising the steps of selecting a group of successive ones of the channels of the array and applying to the channels of said group through said electrically actuable means, energy pulses of a first amplitude, to effect in a first half cycle of operation, droplet ejection from alternate ones of the channels of the selected group and in a second half cycle of operation, droplet ejection from remaining ones of the channels of the group, and applying to channels at opposite sides of said selected group of channels energy pulses of a second amplitude, said first and said second amplitude being dependent on a ratio of said wall compliance and said liquid compliance so as to compensate for pressure cross-talk between channels of the selected group or between said selected group of channels and other channels of the array.

26. The method claimed in claim 25, wherein the step of imparting energy pulses to liquid in the channels comprises applying a channel voltage for each channel.

27. The method claimed in claim 26, wherein each of the channel voltages has a first voltage level in said first half cycle of operation and a second voltage level in said second half cycle of operation.

28. The method claimed in claim 27, in which said selected group of channels comprises an odd number of channels, wherein said first voltage level for odd numbered channels of the selected group is proportional to M, and for even numbered channels of the selected group is zero, wherein said first voltage level for respective channels on opposite sides of and adjacent said selected channel group is proportional to $$\frac{KM}{1+4K}$$

and for respective channels on opposite sides of said selected channel group one, two or more channels removed from said channel group is proportional to $$\frac{2KM}{1+4K}$$

and wherein said second voltage level for even numbered channels of the selected group is proportional to M, and for odd numbered channels of said selected group is zero, and wherein said second voltage level for respective channels on opposite sides of and adjacent said selected channel group is proportional to $$\frac{(1+3K)M}{1+4K}$$

and for respective channels on opposite sides of said selected channel group one, two or more channels removed from said channel group is proportional to $$\frac{(1+2K)M}{1+4K},$$

where M is a scaling factor and K is said compliance ratio.

29. The method claimed in claim 27, in which said selected group of channels comprises an even number of channels, wherein said first voltage level for odd numbered channels of the selected group is proportional to M, and for even numbered channels of the selected group is zero, wherein said first voltage level for the channel adjacent said channel group on the side of the first channel of said group is proportional to $$\frac{KM}{1+4K},$$

for the channel adjacent said channel group on the side of the last channel thereof is proportional to $$\frac{(1+3K)M}{(1+4K)},$$

for each of the channels spaced respectively by one, two or more channels from the first channel of said channel group is proportional to $$\frac{2KM}{1+4K},$$

and for each of said channels spaced by one, two or more channels from the last channel of said channel group is proportional to $$\frac{(1+2K)M}{1+4K}$$

and wherein said second voltage level for even numbered channels of the selected group is proportional to M and for odd numbered channels of said selected channel group is zero, and wherein said second voltage level for the channel adjacent said channel group on the side of the first channel thereof is proportional to $$\frac{(1+3K)M}{(1+4K)},$$

for the channel adjacent said channel group on the side of the last channel thereof is proportional to $$\frac{KM}{(1+4K)},$$

for each of the channels spaced respectively by one, two or more channels from said last channel of said group is proportional to $$\frac{2KM}{1+4K}$$

and for each of the channels spaced respectively by one, two or more channels from said first channel of said channel group is proportional to $$\frac{(1+2K)M}{1+4K},$$

where M is a scaling factor and K is said compliance ratio.

30. The method claimed in claim 28, wherein the scaling factor $$M=\frac{(1+4K)^{\frac{3}{4}}}{3.224K^{\frac{1}{2}}}.$$

31. The method claimed in claim 28, wherein the scaling factor $$M=\frac{\frac{1}{3}(K_{OPT})^{\frac{2}{3}}}{(K)}+\frac{\frac{2}{3}(K)^{\frac{1}{3}}}{(K_{OPT})},$$

where $K_{OPT}$ is the optimum value of K and is given by $K_{OPT}=0.2<K<2$.

32. The method claimed in claim 29, wherein the scaling factor $$M=\frac{(1+4K)^{\frac{3}{4}}}{3.224K^{\frac{1}{2}}}.$$

33. The method claimed in claim 29, wherein the scaling factor $$M=\frac{\frac{1}{3}(K_{OPT})^{\frac{2}{3}}}{(K)}+\frac{\frac{2}{3}(K)^{\frac{1}{3}}}{(K_{OPT})},$$

and where $K_{OPT}$ is the optimum value of K and is given by $K_{OPT}=0.2<K<2$.

* * * * *